US006328454B1

(12) United States Patent
Davis

(10) Patent No.: US 6,328,454 B1
(45) Date of Patent: Dec. 11, 2001

(54) SAFETY LIGHTING

(76) Inventor: Keith Davis, 9142 Edmonston Rd., Greenbelt, MD (US) 20770

( * ) Notice: Subject to any disclaimer, the term of this patent is extended or adjusted under 35 U.S.C. 154(b) by 0 days.

(21) Appl. No.: 09/421,070

(22) Filed: Oct. 19, 1999

Related U.S. Application Data

(60) Provisional application No. 60/109,521, filed on Nov. 23, 1998.

(51) Int. Cl.[7] ..... F21L 4/02; F21W 111/10

(52) U.S. Cl. ..... 362/105; 362/251; 362/800

(58) Field of Search ..... 362/103, 105, 362/106, 234, 251, 800

(56) References Cited

U.S. PATENT DOCUMENTS 4,231,079 * 10/1980 Heminover ..... 362/106
4,665,568 * 5/1987 Stutes ..... 362/106
4,760,373 * 7/1988 Reilly ..... 362/106
4,891,736 * 1/1990 Gouda ..... 362/105
5,040,099 * 8/1991 Harris ..... 362/473
5,327,587 * 7/1994 Hurwitz ..... 362/105
5,357,409 * 10/1994 Glatt ..... 362/105
5,485,358 * 1/1996 Chien ..... 362/106
5,544,027 * 8/1996 Orsano ..... 362/105
5,559,680 * 9/1996 Tabanera ..... 362/106
5,667,294 * 9/1997 Lo ..... 362/250
5,743,621 * 4/1998 Mantha et al. ..... 362/106
5,758,947 * 6/1998 Glatt ..... 362/105
5,871,271 * 2/1999 Chien ..... 362/106

* cited by examiner

*Primary Examiner*—Alan Cariaso
(74) *Attorney, Agent, or Firm*—Robert Halper

(57) ABSTRACT

A lighting device for a safety helmet or the like used for recreational and industrial purposes wherein a plurality of blinking LEDs are disposed on the outer surface of the helmet. The only circuitry needed is a 3 volt battery, an On-Off Switch and wiring for interconnecting the LEDs

7 Claims, 2 Drawing Sheets

SAFETY LIGHTING

Priority for this invention is claimed under 35 USC 119 (e) based on application Ser. No. 60/109,521 filed on Nov. 23, 1998

FIELD OF INVENTION

This invention pertains to a lighting device to be installed on safety helmets and the like.

BACKGROUND OF THE INVENTION

There are a number of safety lighting devices presently being used in connection with recreational activities such as bicycling and work activities such as highway repair as exemplifies by the following:

U.S. Pat. No. 4,231,079 shows a wearing apparel such as a hat that contains a series of LEDs, (light emitting diodes), located in perforations in the hat. A battery supplies power Control circuitry interconnects the battery and diodes to energize the diodes sequentially. A clock emits pulses for an electronic counter, a decoder takes the counter input and controls which diodes are to be sequentially illuminated.

U.S. Pat. No. 4,665,568 is an example of a nightime safety headgear such as a soft cap with a visor and a molded plastic unit supporting two antenna protrusions, each having three LEDs and a single safety light centered in the plastic unit in front of the cap. The LEDs are powered by an electrical system molded directly into the unit and powered by a 3 volt battery. A button on top of the cap activates an On-Off switch.

U.S. Pat. No. 4,760,373 illustrates a motorcycle helmet containing an automatic brake light which shines when the brake pedal is depressed. A transmitter is attached to the motorcycle, and a receiver which activates the light is attached to the helmet. A transmitter encoder and a receiver decoder prevent spurious sources of radio frequency from activating the receiver. A code card is used to guarantee that both encoder and decoder are in synchronization.

U.S. Pat. No. 4,891,736 depicts a rigid helmet having a lens whose surface is flush with the surrounding surface in close proximity to the lens. Three signal lights shine through and about the lens for giving tail, brake and directional directions to following motorists at eye level. The helmet may be equipped with a cable coupled to the cycle on which the wearer rides or the helmet may be telemetered to the cycle by a radio module in the helmet.

U.S. Pat. No. 5,040,099 is a motorcycle helmet with a rearward facing auxiliary brake lamp fastened to the cycle, spaced from and connected optically or sonically to a motorcycle brake lamp. The auxiliary lamp is activated by the illumination of the brake lamp.

U.S. Pat. No. 5,357,409 depicts an illuminated safety helmet that has a protective core and a plurality of LEDs with at least an intensity of 1000 mcd is placed around the core for sequential lighting. The control circuitry includes an oscillator with a ring counter and transistors enclosed in a housing. A power source of series connected batteries activates the control circuitry and LEDs. The housing is electrically connected to the LEDs and is removably attached to the protective core. An impact resistant shell or a skin of stretchable material is disposed in the internal or external surface of the protective core.

U.S. Pat. No. 5,485,358 teaches a universal LED safety light for head wear. The LEDs are mounted on a flexible plate. The plate is one of the straps of a length adjustable belt provided at the rear of the cap. The strap is stitched to the rear of the cap an dused for length adjustment. A circuit board containing a battery, an integrated circuit for triggering the LEDs and an On-Off switch is secured to the cap with "Velcro" ™.

U.S. Pat. No. 5,544,027 illustrates an LED Display for a protective helmet which can either be added to existing helmets or incorporated in a newly manufactured helmet. The LEDs are coupled to a 9 volt battery in the helmet or a bicycle mounted generator via a cord. The LEDs can be lit simultaneously or sequentially by a computer chip.

U.S. Pat. No. 5,667,294 shows a strip sport light with a center strip and two arm strips with multiple light sources for illumination of a center strip and blinking of the side strips dependent on the position of the switch. The center strip contains an electronic printed circuit board and a three step push button switch. The strip sport light may be mounted on a bicycle helmet or on a users head or waist.

The prior art shows various displays of lights or LEDs to be arranged on a helmet or on strips to be placed on a users head or other wearing apparel. The lighting displays are used for safety and ornamental purposes. Whatever the type of apparatus the minimum circuitry required is a PCB. In general however, there are other elements such as 3 way switches, clocks, a plurality of batteries or a nine volt battery, counters, coders, decoders, etc. While these devices have greater flexibility, in that lighting arrangements can be made for steady state, blinking and sequential lighting as well as variable lighting rates, they are considerably more expensive and cumbersome because of the additional circuitry. Another factor to be considered is the problem of repair if one or more of the elements becomes defective.

Accordingly it is an objective of this invention to design a safety and ornamental lighting device to be used on helmets and the like that is simpler in construction.

It is also an object of this invention to provide a lighting device that is less costly for the potential purchaser.

It is a further object of this invention to design a lighting device for a helmet and the like which is lighter and more comfortable to wear.

It is additionally an object of this invention to design a device that is attractive, efficient and less likely to need repair.

SUMMARY OF THE INVENTION

This invention provides an LED display for a helmet or the like wherein the only circuitry involved is an internal power source such as a single 3–6 volt battery, an On-Off switch and wiring to a plurality of LEDs, specially designed for blinking.

DETAILED DESCRIPTION OF THE INVENTION

Figure 1:
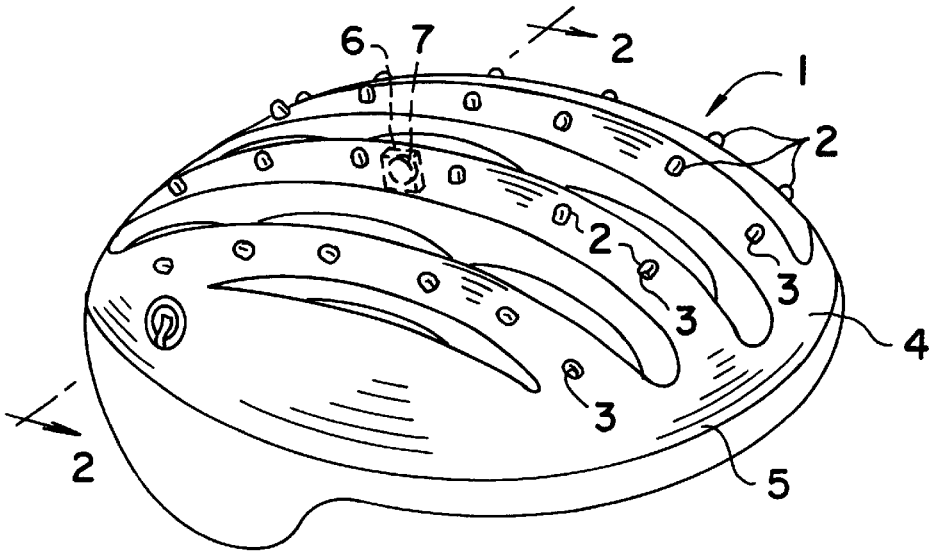
FIG. 1 is a perspective view of the helmet and an LED arrangement.
Figure 2:
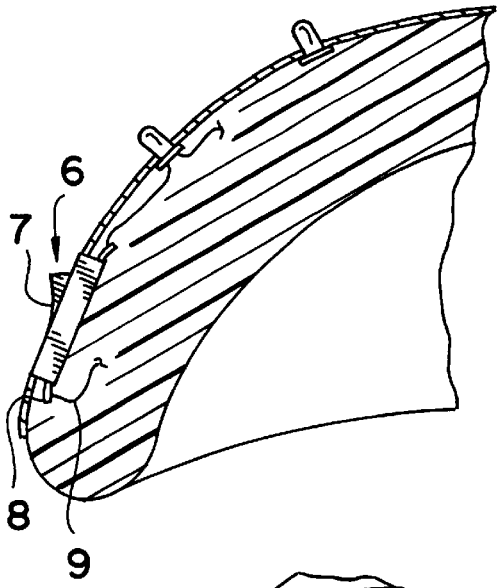
FIG. 2 is a sectional view taken on line 1—1 through the switch and battery and some of the LEDs.
Figure 2:
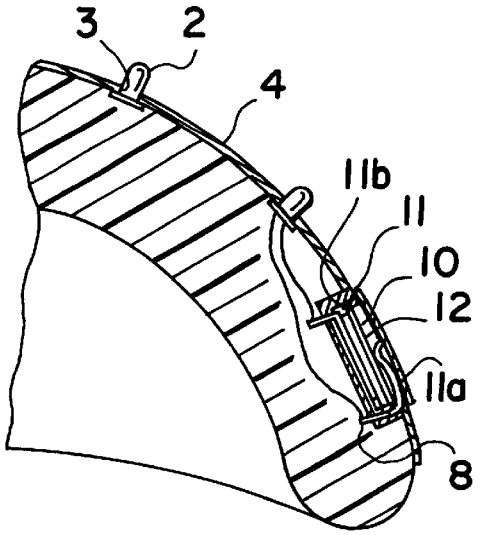
Figure 4:
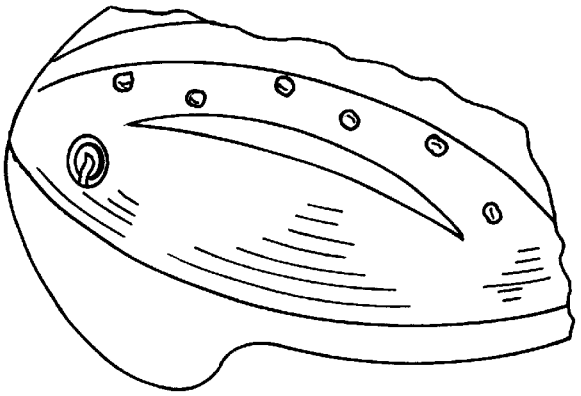
FIG. 4 is a side view of the helmet.
Figure 3:
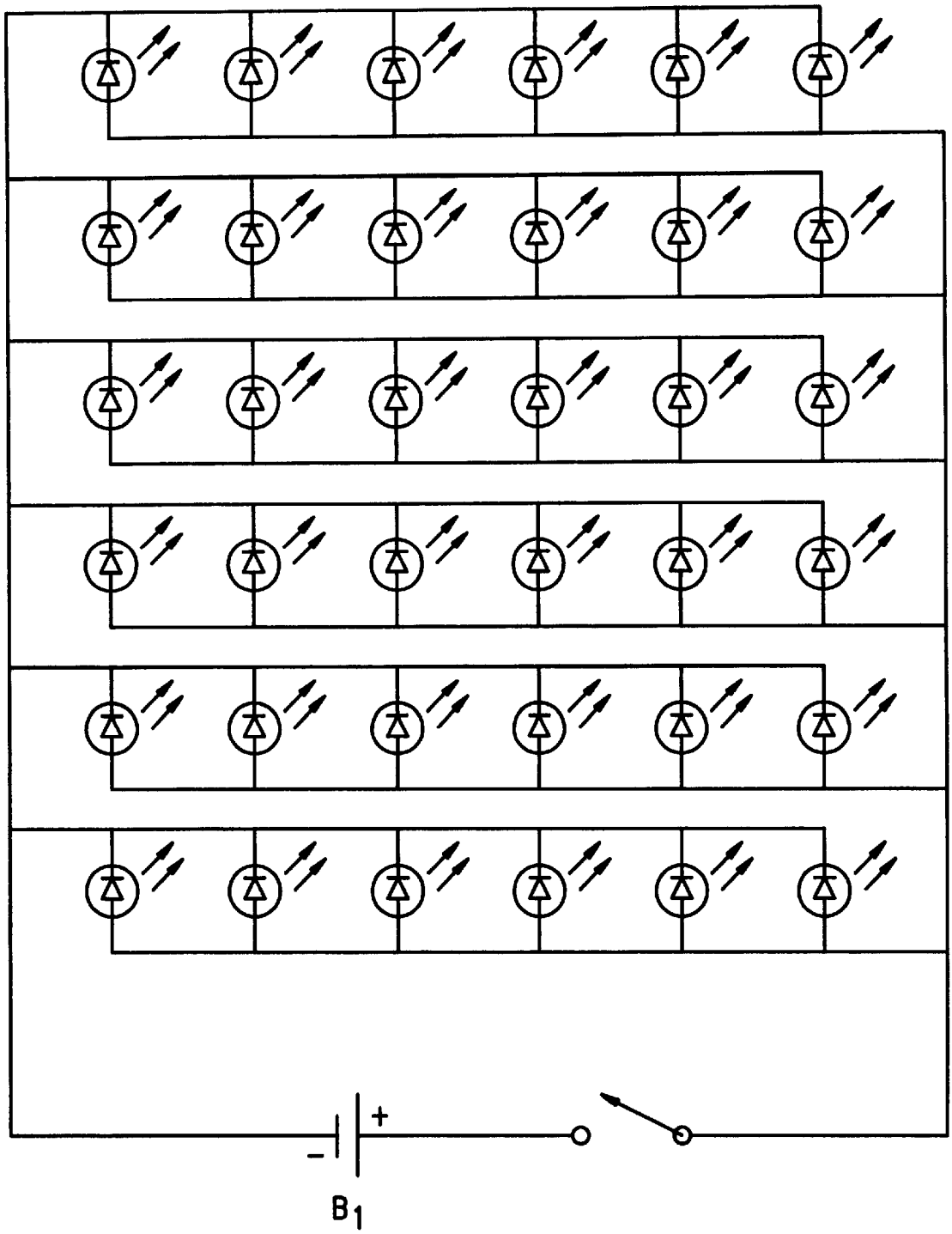
FIG. 3 is a schematic showing the arrangement of the LEDs.

FIG. 1 shows a perspective view of a conventional helmet 1 having an array of light emitting diodes 2 (LEDs) protruding through perforations 3 in a colored plastic liner 4 adhesively attached and covering substantially the surface of the helmet except for a narrow integral segment 5 that extends circumferentially around the base of the helmet. The LEDs are affixed to the liner and are varied in color such as red, green or yellow. They are arranged symmetrically in 4 parallel rows with 6 LEDs in each row. This arrangement is by way of illustration and other designs could be used as well. For example, more or less LEDs could be used. The rows need not be parallel and instead of being symmetrical the LEDs could be staggered. The LEDs are of the blinking type made by "Mouser" and have a forward voltage of 3–6 volts. As shown in FIG. 2, on one side of the helmet toward the rear and below the endmost row of LEDs is an On-Off rocker switch 6. The switch is in the form of a disk 7 which is seated in a square casing that nests in a cut out of the helmet so that the casing is flush with the outer surface of the helmet and the disk is tilted so as to be slightly above the surface of the helmet. At the bottom side of the switch are prongs 8 with wires 9 soldered thereto. Aligned on the opposite side of the helmet is a circular 3–6 volt battery 10 embedded in the helmet. The battery is held in place by an overlapping metal ring 11. In the region of the battery a cutout in the liner is made and a plastic cap 11*a* with a skirt 11*b* fits snugly over the battery with the top of the cap projecting slightly above the periphery of the liner. Affixed to the battery and extending across its top side is a filament 12. This filament serves as the positive connection. A prong 8 at the bottom side of the battery in electrical contact with the positive connection has one of the wires from the switch soldered thereto. The other wire from the switch is soldered to another prong at the bottom side of the battery and serves as the negative connection. The wire from the positively linked prong is electrically joined to the anode of the endmost LED at the rear of the helmet and the wire from the negative connection is electrically joined to the cathode. Additional wiring as shown in FIG. 3 of the schematic, links all the LEDs in parallel, with the switch and battery in series with the LEDs. The battery is generally of the Lithium type and the wire is 16 gauge. In operation turning the switch to the On position will produce a blinking illumination of the helmet that has sufficient intensity to be seen from a distance of about 50–100 feet. The LEDs have a life of about 3 hours steady use. Instead of using multi-colored LEDs, dual colored LEDs could also are used.

It should be understood by those skilled in the art that various changes and variations can be made in the Safety Lighting Device of this invention without departing from the scope of the i invention as defined by the appended claims.

What is claimed is:

1. A safety helmet for use in recreational activities such as cycling or construction activities such as highway repair comprising:

a) a helmet having an outer surface with a front and rear and a lower integral segment, b) a colored plastic liner adhesively secured to said helmet, extending over said surface to said lower segment and containing a plurality of continuously blinking light emitting diodes (LEDs), each having an anode and a cathode affixed to said liner in spaced relationship, c) LED lighting circuitry including an internal power source mounted in said helmet, said power source consisting of a 3–6 volt battery, a cutout in said liner and a plastic cap with a skirt fitting snugly over said battery, said cap projecting slightly above a periphery of said liner, an On-Off switch electrically connected to the battery and wiring extending from said battery to connect each of said LEDs in parallel.

2. A safety helmet as in claim 1 wherein said LEDs are varied in color.

3. A safety helmet as in claim 1 wherein said plurality of LEDs are arranged in 4 parallel rows with 6 LEDs to a row, 2 of said rows being lowermost rows.

4. A safety helmet as in claim 1 wherein said plurality of LEDs are arranged in 4 rows, said LEDs in each row being staggered with respect to adjacent rows.

5. A safety helmet as in claim 3 where said battery is a 3 volt lithium battery having a top side and a bottom side and mounted in an indent in said helmet, an overlapping metal ring securing said battery, a positive filament affixed to said battery at one end and extending across said top side a prong at said bottom side being in electrical contact with said positive filament, a second prong at said bottom side serving as a negative connection a lead wire from said prong in electrical contact with said positive filament being linked to said LED anode and a lead wire from said negative connection linked to said LED cathode, and wiring extending from said LED to electrically connect all of said LEDs, said LEDs being connected in series with said switch and said battery.

6. A safety helmet as in claim 5 wherein said switch is a rocker switch, said switch being seated in a square casing flush with said surface of said helmet, said switch being a disk tilted so as to be above the surface of said helmet, said switch having prongs at a bottom side thereof, and wires in electrical contact with said prongs and electrically connected to said prongs on said battery, said switch being located at said first rear portion of the helmet below an endmost row of LEDs and said battery being in alignment with said switch and located at said second rear portion.

7. A safety helmet as in claim 1 wherein the intensity of said LEDs is about 1.5–5 millicandelas (mcds), said LEDs have a visibility range of 50–100 feet and a life of 3 hours.

* * * * *